United States Patent [19]

Poux

[11] 4,380,877

[45] Apr. 26, 1983

[54] FLUID CIRCULATION APPARATUS USING FLUID FLOW DEFLECTION GRATING

[75] Inventor: Jacques Poux, Grenoble, France

[73] Assignee: Alsthom-Atlantique, Paris, France

[21] Appl. No.: 286,397

[22] Filed: Jul. 23, 1981

[30] Foreign Application Priority Data

Jul. 23, 1980 [FR] France ..... 80 16221

[51] Int. Cl.[3] ..... F26B 21/02

[52] U.S. Cl. ..... 34/225; 34/151; 34/231; 239/556; 239/567

[58] Field of Search ..... 34/218, 219, 224, 225, 34/232, 233, 231, 151; 239/556, 567

[56] References Cited

U.S. PATENT DOCUMENTS 1,293,799 2/1919 King ..... 34/231

4,304,053 12/1981 Kellerhals et al. ..... 34/225

FOREIGN PATENT DOCUMENTS 107009 3/1943 Sweden .

*Primary Examiner*—Larry I. Schwartz

*Attorney, Agent, or Firm*—Sughrue, Mion, Zinn, Macpeak and Seas

[57] ABSTRACT

An inlet grating (11) is constituted by a thin corrugated sheet having rounded corrugation tops (15) facing incident gas flow (25) arriving at an oblique angle. The corrugations are parallel and regularly spaced with perforations at the bottoms thereof (23). Suitable choice of dimensions, together with optional auxiliary openings (24), can ensure a uniform flow perpendicular to the plane of the trough bottoms at a suitable distance therefrom. This is of particular application to drying apparatus.

5 Claims, 5 Drawing Figures

FLUID CIRCULATION APPARATUS USING FLUID FLOW DEFLECTION GRATING

The present invention relates to a deflection grating and to circulation apparatus using the grating. It is particularly applicable to circulation chambers used to put a gas into contact with a solid as in a dryer or a furnace, or to put a gas into contact with a liquid or with a solid in suspension in the apparatus, as in a cleaning, absorption or cooling tower.

BACKGROUND OF THE INVENTION

Fluid circulation chambers generally include an inlet fluid distributor grating and an outlet fluid collector grating. The inlet grating is intended to deflect the flow and to decelerate the fluid, while the outlet grating is intended to deflect the flow and to accelerate the fluid, the idea being to obtain uniform fluid velocity between the gratings.

In conventional chambers of this type, the inlet and/or outlet gratings are constituted by thin, plane, perforated metal sheets which are generally associated with inlet and outlet passages of constant height. Since the thinly-edged perforations through these grids have no effect on the tangential components of the inlet air velocity, large oblique velocity components remain inside the chamber in spite of the spreading out effect of the inlet grating. These high velocity components, combined with the effect of the walls of the chamber, leave the air un-evenly spread out inside the chamber.

A system for correcting inlet flow may be improved by creating a flow deflecting effect using a thick perforated sheet, such that the ratio of the sheet thickness to the diameter of the perforations is high, and in any case greater than five. Any fluid entering such perforations obliquely tends to stick to the walls thereof and thus leaves flowing along a direction substantially perpendicular to the plane of the sheet. This arrangement suffers from the drawback of either requiring sheets that are thick, heavy and expensive, or else requiring medium thickness sheets that are perforated by very small holes which tend to become clogged with any solid particles that may be in suspension in drying air, for example.

Another way of improving flow correction that is sometimes successful is to use a honey-comb panel of sufficient thickness to deflect the flow appreciably. Nonetheless, a honey-comb has the disadvantage of head loss that is low, and highly variable depending on the angle of incidence of the fluid on its inlet side. Honey-combs are thus primarily used in situations where the fluid to be deflected is is itself applied to the panel at a speed and along a direction that are both uniform and regular. This can require the addition of a perforated sheet to provide improved spreading out of the fluid at the cost of extra average head loss. An additional drawback is that glued honey-combs are useable only at fairly low temperatures.

Likewise, at the outlet from the chamber, a large suction pressure difference must be created along the outlet passage to enable the air to leave it rapidly in a direction which is generally perpendicular to the plane of the outlet sheet. This pressure difference further upsets the uniformity of flow through the chamber. One way of combatting the effects of the suction pressure difference required along the outlet passage is to use an outlet grating that causes a head loss which is large in comparison with the suction pressure difference. This leads to the use of sheets with excessive head losses giving mediocre results even when used in conjunction with divergent passages.

Preferred embodiments of the invention provide gratings which ensure adequate uniformity in the flow of fluid downstream from an inlet grating and/or upstream from an outlet grating. This is done simply and without excessive head loss.

SUMMARY OF THE INVENTION

The present invention provides afluid flow deflection grating for receiving an incident flow of fluid arriving along an incident direction and for forming an exit flow of fluid leaving along an exit direction that is at least 45° different from the incident direction and with fluid flow that is substantially uniform over its entire cross section at a distance from the grating, wherein said grating is generally in the shape of a panel constituted by at least one thin corrugated and perforated sheet, each corrugation being in the form of at least two substantially plane strips extending lengthwise in a direction perpendicular to both the incident and the exit directions, and at least some of the perforations in said sheet being through those of said strips whose plane is substantially perpendicular to the exit direction.

In the case of an inlet grating, the grating is disposed as a panel extending perpendicularly to the exit direction and each corrugation of the sheet preferably comprises, from the exit side to the inlet side:

a bottom strip that is substantially plane and parallel to the average plane of the panel, the width of said bottom strip being not more than 1.5 times the projection of the corrugation pitch on a plane perpendicular to the incident direction, said bottom strip being perforated by main perforations;

two substantially plane flank strips situated on either side of the bottom strip and diverging away from each other; and a curved top strip connecting one flank strip of one corrugation with the other flank strip of the adjacent corrugation, the curve of the top strip being convex towards the incident flow.

The height of the corrugations is preferably from 1.5 to 5 times the width of the bottom strip.

In the case of an outlet grating, the grating is disposed as a panel extending perpendicularly to the incident direction and each corrugation of the sheet preferably comprises:

a substantially plane guide strip to divert the incident flow towards the perforations; and a perforated strip disposed substantially perpendicular to the plane of the panel;

the perforation through the perforated strip extending substantially over its entire width such that fluid leaves through said perforations in oblique jets that do not stick to the panel, said jets diffusing to reconstitute a downstream flow that is uniform and steeply inclined to the plane of the panel.

The invention also provides fluid circulation apparatus for causing an object to interact with a uniform flow of fluid through a chamber, wherein the apparatus includes an inlet grating as defined above, and means for holding said object downstream from the inlet grating at a distance that is at least ten times the pitch of the corrugations of the inlet grating.

BRIEF DESCRIPTION OF THE DRAWINGS

Embodiments of the present invention are described by way of example with reference to the accompanying drawings in which.

DETAILED DESCRIPTION

Drying, and in particular drying a multitude of objects that must not be allowed to touch one another until dry, often leads to the use of large drying chambers in which the objects being dried do not offer much resistance to the flow of hot drying gas. To obtain uniform results, the drying fluid must be at uniform temperature and humidity, and it must be made to flow at uniform speed past the objects being dried wherever they are located in the chamber. Further, the fluid must circulate fast enough to ensure high dryer throughput and thereby reduce the overheads, per item dried, of capital expenditure and of heat losses through the dryer walls. For reasons of economy, the drying fluid is generally recycled over the product being dried, which requires suitable re-heating and drying, e.g. by bleeding off a fraction of hot wet air and replacing it with fresh dry air. For the same reason of economy, the space available for housing the fluid recycling equipment is generally so small that the fluid is made to flow through it at a much higher speed than it flows through the drying chamber. There is thus a need both to admit air at high speed into the chamber under adequate control, and to remove it therefrom. Both of these functions are performed by using deflection gratings in accordance with the invention.

Figure 1:
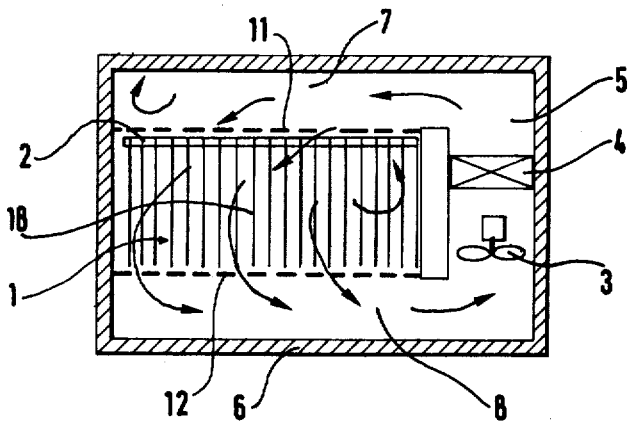
FIG. 1 is a diagrammatic transverse section through a prior art dryer.

In FIG. 1, a prior art drying chamber 1 contains sheets or "curtains" of pasta 18 suspended from horizontal canes 2. The canes and their loads of pasta move horizontally through the dryer in a direction perpendicular to the plane of the figure. To simplify the figure, only one curtain of pasta is shown. The chamber is enclosed by a thermally insulating wall 6, inside which the air is recycled by a fan 3 and passed through a battery of heater elements 4 located in a side passage 5. Hot air then passes into an upper inlet passage 7 whence it passes through a plane inlet grating 11 above the curtain of pasta. The air speed in the upper passage 7 may be more than three to five times the average desired air speed over the pasta to be dried. The air leaves the drying chamber 1 through a plane outlet grating 12 and is sucked out via a lower outlet passage 8 likewise at high speed. The high kinetic energy of the air in the upper passage 7, combined with the suction of the fan 3 into the lower passage 8 leads to a high degree of dynamic disequilibrium which results in a velocity distribution over the pasta which is highly irregular, both in direction and in amplitude, with maxima that are two to three times the expected average being experienced on the side far from the side passage 5, and with minima that may even include reverse flow eddies occuring in the upper parts of the pasta curtain nearest to the side wall 5. This leads to most unequal drying of the pasta, which results in the dryer's throughput being reduced, even if the direction of air flow is periodically reversed, since drying is not a linear function of time. A holding silo is thus required at the output from the drying chamber in which pasta humidity is brought to a uniform level, in spite of some of the pasta being more thoroughly dried than the rest.

To simplify FIG. 1, the apparatus required for bleeding off hot wet air and for introducing fresh dry air has not been shown. In practice such apparatus is controlled to ensure a desired average humidity of the drying air.

Figure 2:
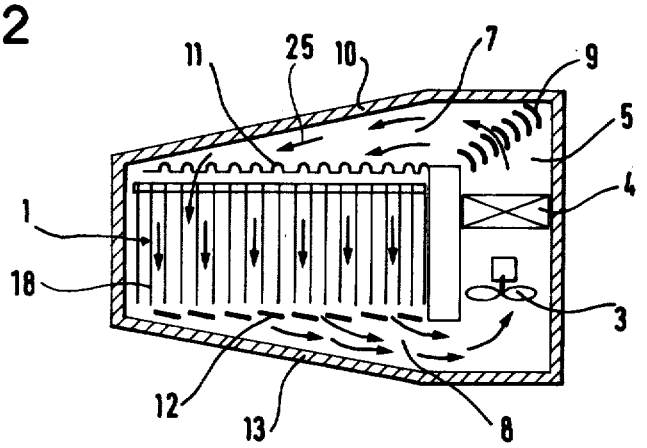
FIG. 2 is a diagrammatic transverse section through a dryer incorporating gratings embodying the invention.

FIG. 2 is a similar diagram to FIG. 1, and shows a dryer incorporating the invention to obtain a well-distributed flow of drying air over pasta. Air coming from the side passage 5 flows into the upper passage 7 after deflection in conventional manner through a deflection grating 9. The upper passage 7 converges by virtue of the top wall 10 of the dryer being disposed on a slope. The cross section of the upper passage 7 thus gets smaller linearly which, as is well known, is the theoretical requirement for ensuring compatibility between uniform removal of air through the inlet deflection grating, and uniform air speed and air pressure inside the passage 7. Likewise, at the outlet from the curtains of pasta, the outlet grating 12 deflects and accelerates the air and sends it obliquely into the lower passage 8 which diverges by virtue of the bottom wall 13 of the dryer being on a slope. The cross section of the lower passage 8 gets larger linearly in a manner suitable for ensuring uniform flow through the outlet grating 12.

The air speed and pressure can thus be made uniform inside the inlet passage 7, inside the drying chamber 1 around the pasta, and inside the outlet passage 8, provided that the inlet grating 11 deflects the oblique flow along the inlet passage 7 into a vertical flow past the pasta, and provided the outlet grating 12 deflects the vertical flow past the pasta into a suitably oblique flow to match the slope of the bottom wall 13.

Figure 3:
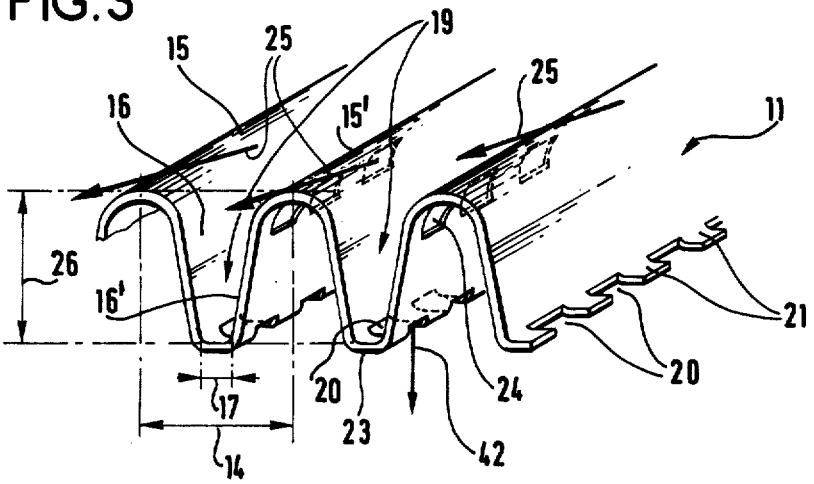
FIG. 3 is a diagrammatic perspective view of a part of the inlet grating shown in FIG. 1.

A detail of part of the inlet deflection grating 11 is shown in FIG. 3. It is made by stamping a thin panel to obtain corrugations defining conventionally, peaks and valleys, said corrugations having rounded tops 15 on the side of the inlet passage 7. The corrugations are parallel and they are spaced at a pitch 14. The rounded tops 15 run into flanks 16 on their upstream sides relative to the flow in the passage 7 and 16' on their downstream sides. The direction of flow is shown by an arrow 25. The flanks are straight and inclined to the normal to the plane of the panel. They form troughs 19 which converge slightly towards their bottoms 23 forming said valleys in which there are perforations 20 with connecting tongues 21 in between. The bottoms of the troughs may be substantially flat, or they may be rounded. The width 17 at the bottom of a trough 19 is not more than 1.5 times the projection of the corrugation pitch 14 on a plane perpendicular to the generally oblique direction 25 of the incident air flow. Under normal conditions, this results in the approach speed of the air that is deflected to the bottom of the troughs being at least equal to 0.6 times the speed of the incident flow.

The air escapes from the grating 11 via the perforations 20, which may be circular, oblong, square or rectangular. The perforations should not occupy more than 85% of the bottoms of the troughs in order to ensure that the remaining tongues 21 are wide enough to provide adequate mechanical strength for the panel.

The perforations may occupy as little as 50% of the available area in order to improve the distributing effect of the grating, but this will be at the expense of increased head loss. The height 26 of a trough should be between 1.5 and 5 times the width 17 of the bottom of a trough. The flanks 16 and 16' should not be inclined at more than 20° from the normal to the plane of the panel. The fluid leaves the perforations 20 in the form of high-speed jets, which diffuse to form a flow of uniform speed at a distance downstream from the grating that is about ten times the corrugation pitch 14.

In practice, a deflection grating of given shape adapted to a particular angle of incidence retains its properties of deflection and distribution over a wide range of angles of incidence ranging from normal to the grating to some maximally oblique angle. The smaller the ratio of the trough with 17 to the corrugation pitch 14, the more oblique the maximally oblique angle. At angles of incidence that are too oblique for a given grating, the flow comes unstuck at the rounded edges 15' of the corrugation tops 15 and then strikes and bounces off the downstream flanks 16 of the troughs 19. This can even lead to the jets coming out of the perforations 20 flowing in substantially the opposite direction to the incident flow 25.

To improve the performance of the grating at highly oblique angles of incidence, auxiliary perforations 24 may be provided in the upstream flanks 16 of the troughs just below the tops 15. Fluid sucked in through the auxiliary perforations 24 prevents the flow from coming unstuck over a further range of increasingly oblique angles of incidence.

Further, the fluid sucked in through the auxiliary perforations 24 helps fill out the flow in between the jets through the main perforations 20, and thus improves the uniformity of the flow downstream from the panel. The area of the auxiliary perforations as a whole should not exceed that of the main perforations.

A deflection grating as shown in FIG. 3 has important aerodynamic features as well as important technical and economic features.

Aerodynamically, the grating adjusts to a wide range of angles of incidence. This is due in particular to the rounded shape of the tops 15 and to the converging shape of the troughs 19 in between the rounded flanks 16 and 16'. This combination of features of shape causes the flow through the throughs to be substantially without loss of speed or head. The head loss due to the grating is only slightly dependant on the angle of incidence, with nearly all the loss being due to the flow through the main perforations 20 opening suddenly into a larger space. The grating thus has nearly the minimum possible loss compatible with its functions of diverting and spreading out a flow of fluid that arrives obliquely at the grating.

Technically, the grating is manufactured by stamping, which gives a highly regular, rigid and light grating without any welding, soldering or glueing. This means that if the grating is made of metal there is no difficulty in working at high temperatures. Further, due to its rounded shape facing the fluid flow and to its lack of re-entrant corners, there is little tendency for it to becomes clogged with particles of dirt.

Since grating manufacture thus uses techniques that are conventional in manufacturing perforated corrugated metal sheet, and that require little manual intervention, the end product is particularly economical.

The pitch of the corrugations is chosen to be less than one tenth of the distance between the grating and the pasta 18 to ensure uniform flow over the curtains of pasta.

Figure 4:
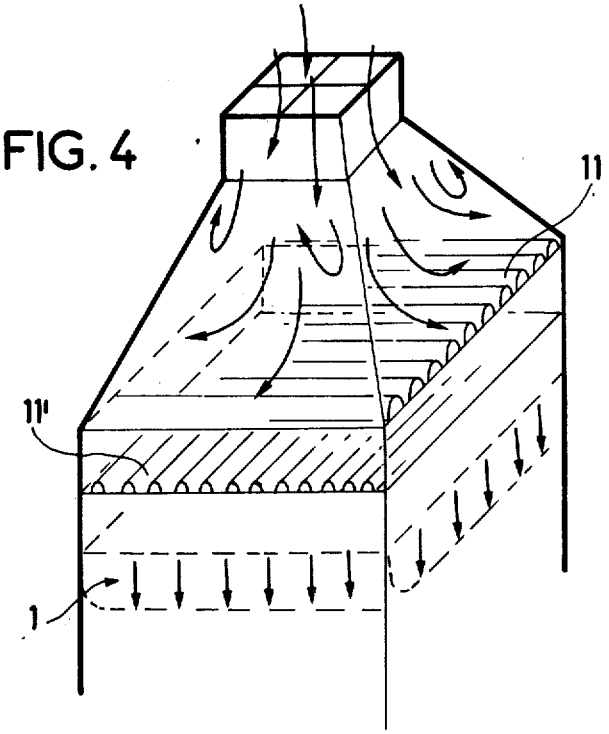
FIG. 4 is a diagrammatic perspective view of a second dryer incorporating gratings embodying the invention.

A grating in accordance with the invention is not limited to a case where the incident air arrives at an oblique angle. For example, a tower shaped drying chamber as shown in FIG. 4 may use two gratings 11 and 11'. Hot air enters flowing downwards in a funnel shaped portion above a generally cubic drying chamber and passes through both gratings which are disposed horizontally one above the other before entering the drying chamber proper. The two gratings are crossed such that their corrugations are at right angles to each other, thereby ensuring a very even distribution of air downstream from the lower grating.

Figure 5:
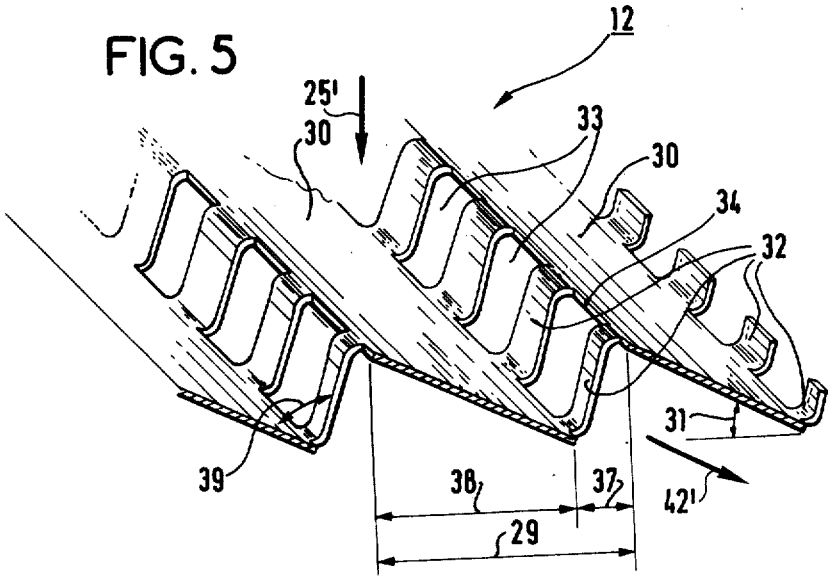
FIG. 5 is a diagrammatic perspective view of a part of a dryer outlet grating embodying the invention.

FIG. 5 shows an embodiment of the outlet grating 12 from the chamber 1 for directing air into the outlet passage 8.

The outlet grating 12 serves to accelerate the air and to deflect it from the direction of flow indicated by the arrow 25' to the direction indicated by the arrow 42'. The grating 12 is constituted by a thin sheet in which perforations 33 are initially formed. Then the sheet is folded or corrugated thus defining conventionally peaks and valleys in a stamping operation to form parallel ridges 30 spaced apart at a pitch 29. The non-perforated portions of the ridges 30 constitute guide portions or guide stripes that are inclined at an angle 31 to the general plane of the grating, and the steeper the angle of deflection, the smaller the angle 31. The perforated portions of the ridges 30 comprise tongues 32 and perforations 33 in between the tongues. The perforations 33 are square, but they could equally well be rectangular, oblong or circular.

The fluid flow arriving downwardly on the grating 12 is separated into flows proper to each ridge by the leading edges 34 of the ridges 30, and each flow is then deflected by the adjacent guide portion to flow out through the perforations 33.

The ridges are asymmetrical, with the projection 37 of the perforated portion on a horizontal plane being smaller than the projection 38 of the guide portion. The sum of the projections 37 and 38 is the pitch 29. The greater the ratio of the larger projection 38 to the pitch 29, the easier it is to obtain the desired deflection for smaller head loss. The limiting factor in reducing the smaller projection 37 is the extent to which the tongues 32 can be bent without excessively weakening the grating. Generally the projection 37 will be about twice the minimum internal bending radius of the sheet from which the grating is made. It is thus typically five times the thickness of the sheet.

It is not essential that the outlet fluid flow arrives normally to the grating. The component of velocity normal to the guide portion is deflected while the tangential component parallel to said portion is conserved and the component normal to the plane of the grating is restituted after the outlet jets have diffused.

The most frequent and most profitable use of the grating 12 is for it to be used without any component of incident fluid velocity parallel to the guide portions. For any given grating, the outlet angle and speed vary as a function of the angle of approach compared to the normal to the plane of the grating. However, for gratings that provide more than 70° of deflection, the outlet angle varies little for angles of arrival within 20° of the normal, so the grating can then be used anywhere in this range, so it might be placed at an angle to the outlet from the drying chamber.

Outlet gratings in accordance with the invention have deflection and distribution capacities, particularly when used in conjunction with a divergent outlet passage 8, that are close to the maximum capacities that could theoretically be obtained with a grating using turbine type blades, but they have the advantages of simplicity and cheapness in manufacture, and being strong enough to be used in large formats.

I claim:

1. A low head loss fluid circulation apparatus, said apparatus comprising:

duct means defining a circulation fluid flow path, a drying chamber or the like within said flow path formed by an upstream inlet grating spanning said flow path and spaced from a downstream outlet grating which also spans said flow path and with said gratings extending generally parallel to each other and perpendicular to the flow path, and wherein said flow path duct means include at least an oblique flow path portion upstream of said inlet grating and leading thereto, and wherein said inlet grating comprises a fluid flow deflection grating for receiving an incident flow of fluid arriving along an incident direction defined by said first oblique flow path portion and for forming an exit flow of fluid leaving along an exit direction that is at least 45° different from the incident direction, and wherein the fluid flow is substantially uniform over its entire cross-section at a distance from the grating, said inlet fluid flow deflection grating being in the shape of a panel constituted by at least one thin, corrugated, perforated sheet, each corrugation being in the form of at least two substantially plane flank strips, said plane flank strips and said corrugations formed thereby extending lengthwise in a direction perpendicular to both the fluid flow incident and exit directions, said plane flank strips being spaced from each other and being joined by a bottom strip to define with said plane flank strips a valley opening to the fluid flow incident direction, at least some of the perforations in said sheet being through said bottom strips, and wherein said perforations extend over at least fifty percent of the surface area of said bottom strips.

2. The fluid circulation apparatus as claimed in claim 1, wherein, for each corrugation of the inlet fluid flow deflection grating from the valley outwardly to the inlet side, said bottom strip is substantially plane and parallel to the average plane of the panel, said bottom strip has a width not more than 1.5 times the projection of the corrugation pitch on a plane perpendicular to the incident direction, said bottom strip being perforated by main perforations; said substantially plane flank strips being situated on either side of said bottom strip and diverging away from each other; and wherein said inlet fluid flow deflection grating further comprises; a curved top strip connecting one flank strip of one corrugation with the other flank strip of the adjacent corrugation, with the curve of the top strip being convex towards the incident flow, and wherein auxiliary perforations are located through the sheet where each top strip runs into the flank strip immediately downstream therefrom in the incident direction, and wherein the height of each corrugation is from 1.5 to 5 times the width of the bottom strip.

3. The fluid circulation apparatus as claimed in claim 1, wherein said duct means further comprises an oblique flow path portion downstream of said outlet grating and leading therefrom for directing fluid flow obliquely away from said outlet grating, said outlet grating comprising a fluid flow deflection outlet grating and constituting a panel extending perpendicular to the incident direction and being in the form of one thin corrugated and perforated sheet, and wherein each corrugation of the sheet comprises assymetrically folded ridges including alternately oppositely inclined non-perforated guide strips and perforated ridge portions forming valleys therebetween, said perforated portions being at a steeper angle with respect to the average plane of the panel than said plane guide strips, such that said plane guide strips divert the incident flow towards the perforations of said perforated portions, and wherein the perforations extend substantially over the entire width of said perforated portions of said corrugated sheet such that the fluid leaves through the perforations in oblique jets that do not stick to the panel, and wherein said jets diffusing to reconstitute a downstream flow that is uniform and steeply inclined to the plane of the panel and conforms to the oblique flow path portion of said duct means downstream of said outlet grating.

4. The fluid circulation apparatus as claimed in claim 2, wherein said duct means further comprises an oblique flow path portion downstream of said outlet grating and leading therefrom for directing fluid flow obliquely away from said outlet grating, said outlet grating comprising a fluid flow deflection outlet grating and constituting a panel extending perpendicular to the incident direction and being in the form of one thin corrugated and perforated sheet, and wherein each corrugation of the sheet comprises assymetrically folded ridges including alternately oppositely inclined non-perforated guide strips and perforated ridge portions forming valleys therebetween, said perforated portions being at a steeper angle with respect to the average plane of the panel than said plane guide strips, such that said plane guide strips divert the incident flow towards the perforations of said perforated portions, and wherein the perforations extend substantially over the entire width of said perforated portions of said corrugated sheet such that the fluid leaves through the perforations in oblique jets that do not stick to the panel, and wherein said jets diffusing to reconstitute a downstream flow that is uniform and steeply inclined to the plane of the panel and conforms to the oblique flow path portion of said duct means downstream of said outlet grating.

5. The fluid circulation apparatus as claimed in claim 4, further comprising means for holding an object downstream from the inlet grating at a distance that is at least ten times the pitch of the corrugation of the inlet grating and upstream of said outlet grating such that the object being held interacts with a uniform flow of fluid through said chamber.

* * * * *